US006080949A

United States Patent [19]

Weber et al.

[11] Patent Number: 6,080,949

[45] Date of Patent: Jun. 27, 2000

[54] QUICK-BREAK SWITCH WITH A REINFORCED PRESSURE POINT

[75] Inventors: Adam Weber, Bietigheim-Bissingen; Christel Duster, Sachsenheim; Jakob Botz, Ingersheim, all of Germany

[73] Assignee: ITT Manufacturing Enterprises Inc., Wilmington, Del.

[21] Appl. No.: 09/230,187

[22] PCT Filed: Jul. 11, 1997

[86] PCT No.: PCT/EP97/03688

§ 371 Date: May 24, 1999

§ 102(e) Date: May 24, 1999

[87] PCT Pub. No.: WO98/03982

PCT Pub. Date: Jan. 29, 1998

[30] Foreign Application Priority Data

Jul. 18, 1996 [DE] Germany ..... 196 29 006

[51] Int. Cl.[7] ..... H01H 13/28

[52] U.S. Cl. ..... 200/437; 200/438; 200/449

[58] Field of Search ..... 200/402, 405–408, 200/410, 412, 416, 417, 431, 433–439, 448, 449, 451, 16 R, 16 A, 16 C, 16 D

[56] References Cited

U.S. PATENT DOCUMENTS

| | | | |
|---|---|---|---|
| 2,779,835 | 1/1957 | Russell | 200/76 |
| 2,853,573 | 9/1958 | Wang | 200/67 |
| 4,006,333 | 2/1977 | Hults | 200/157 |
| 4,636,597 | 1/1987 | Menuche | 200/68.1 |
| 5,821,481 | 10/1998 | Neubauer | 200/4 |

FOREIGN PATENT DOCUMENTS

| | | | |
|---|---|---|---|
| 3336877 | 5/1985 | Germany | H01H 13/52 |
| 3626241 | 2/1988 | Germany | H01H 25/04 |
| 4418707 | 11/1995 | Germany | H01H 9/02 |
| 4436979 | 4/1996 | Germany | H01H 5/04 |
| 2068172 | 8/1981 | United Kingdom | H01H 5/04 |

*Primary Examiner*—Michael Friedhofer
*Attorney, Agent, or Firm*—J. Gordon Lewis

[57] ABSTRACT

A quick-break switch in which, for switching-over purposes under the spring force (1) of a switching element, the two individual wedge faces of a wedge surface are felt. In order to render the pressure point more perceptible, in particular when the switch is manually operated, the wedge faces are curved. These curves can also help to improve the switching behavior of the switch with respect to the switching process and contact-making.

10 Claims, 2 Drawing Sheets

QUICK-BREAK SWITCH WITH A REINFORCED PRESSURE POINT

BACKGROUND OF THE INVENTION

The invention pertains to an electric switch, in particular, for motor vehicles with a housing in which a contact lever can move between two end settings within the housing. The electrical switch is equipped with a moveable switch piece to initiate the reversing process and with at least one fixed contact. One of the two elements, namely the contact lever or the switch piece, bears a wedge profile while the other of the two elements has a switching element which senses the contour of the wedge profile during switching. In addition, the two mutually cooperating elements are pre-tensioned with respect to each other in the sensing direction and, as a rule, the sensing direction runs perpendicular to one motion direction in which the two mutually cooperating elements are displaced with respect to each other during the switching.

A switch of this kind is described, for example, in DE-OS 33 36 877, and here both the switch element and also the wedge profile are each formed by a wedge. From DE-OS 44 18 707, a corresponding switch by the applicant is known, in which the known wedge-shaped switch element was replaced by a pre-tensioned sensing roller.

With regard to the design according to DE-OS 44 18 707, it has already been proposed to exchange the wedge profile and the switching element having a curved sensing surface with each other so that the switching piece is provided with a spring tensioned wedge profile.

Therefore the invention proceeds from an electrical switch of the kind in which the contour of the wedge surface is straight. This means that the opposing force exerted by the switching piece when pressed in, is roughly proportional to the distance by which the switch piece is pressed in. Thus, upon manual operation of the switching piece, the opposing force is exerted by the switching piece against the operator increases linearly up to the point where the wedge peak is reached by the switching element. From this point on, the snap action of the switch begins, through which the contact lever is automatically brought into its second contact position. Due to the linear increase in force in the first activation phase of the switch piece, the operator is not able to tell in which region the switching point is actually reached. Thus the switch will reverse at a moment which cannot be determined precisely by the operator.

The purpose of the invention is to make clearly discernible the approach of the pressure point for the operator.

SUMMARY OF THE INVENTION

In principle, the invention consists of starting from the known linear dependence of the force exerted by the switching piece with respect to the path traversed by the switching piece, and to introduce a nonlinear relationship. This nonlinear relationship is achieved by means of a curved profile. In addition, due to this kind of curbed surface in certain regions, it is possible to control the speed and the acceleration at which the electrical contact are brought together. Thus, within certain limits, the collision tendency of mutually approaching contacts can be controlled, or the speed at which the contacts are brought together, can be controlled for the prevention of electric arcing.

If the goal is a non-linear increase of the opposing force of the switching piece just before reaching the pressure point, then, in a refinement of the invention, the curvature of the contour sensed from the beginning of the switch operation until the transition point is selected such that the force exerted on the switch piece increases disproportionately with respect to the path traversed by the switch piece. Of course, the principle can be applied to both wedge surfaces for a reversing switch acting in two directions, in which the contact lever makes a fixed contact in its two end settings.

A particularly simple construction is obtained by pretensioning the wedge in the switch piece in the pretension direction. Thus the design of the contact lever will be greatly simplified, so that any otherwise occurring problems will be eliminated when it is seated. In addition, the contact lever will thus be lighter, so that it is easer to accelerate and tends to rebound less.

The curvature of the wedge profile can be both convex and also concave, depending on the objectives to be achieved.

BRIEF DESCRIPTION OF THE DRAWING

One design example of the invention will be explained in greater detail below with reference to the figures in which.

DESCRIPTION OF THE PREFERRED EMBODIMENTS

Figure 1:
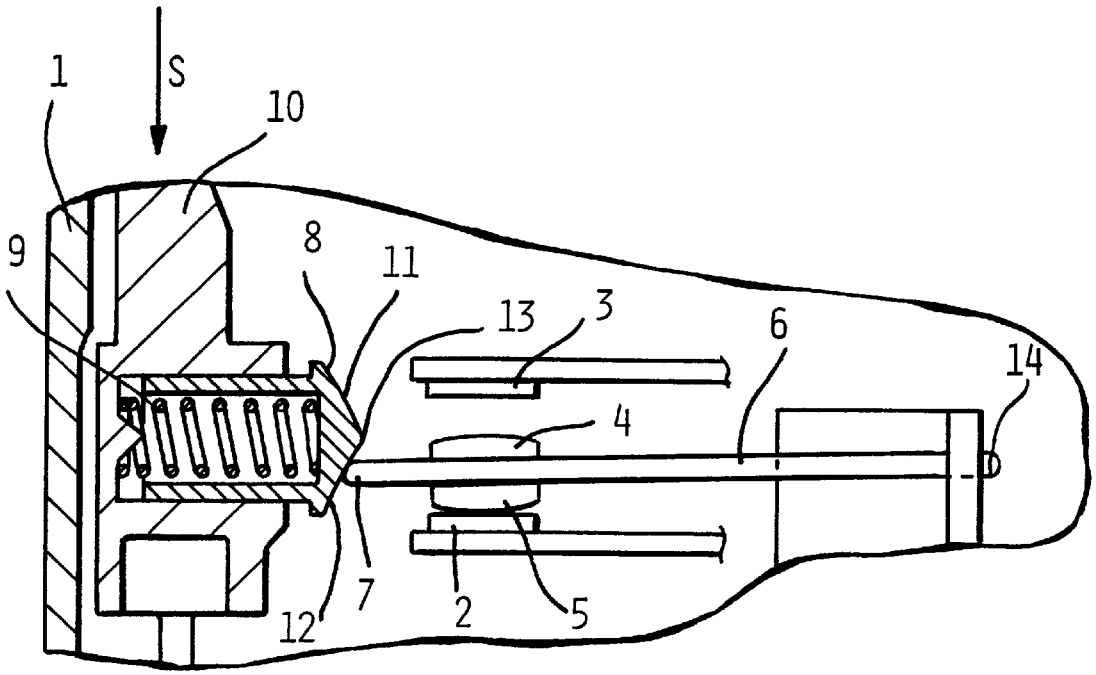
FIG. 1 is a cross section from a cut-away representation of the switch.

The switch forms a section of a manually operated sensor switch onto which a manually operated sensor can be placed. Within the switch housing 1 there are two fixed contact 2, 3, which cooperate with two moving contacts 4, 5, which are attached to one contact lever 6. The contact lever 6 is pivot mounted in a knife-edge support 7, and the free end of the contact lever 6 is configured as switching element 7. A wedge element 8 can slide horizontally in a switching piece 10 under the effect of a pretensioning spring 9. The switching piece 10 itself can be pressed in a perpendicular direction S by means of a key (not illustrated). By means of a spring (not illustrated) which acts on the lower end of the switching piece 10, the switching piece 10 can recoil automatically opposite to the direction of the arrow S after operation of the contact. In the illustrated, standard position, due to the force of the spring 9, which is transferred proportionately via a wedge profile at the free end of the wedge element 8 to the knife-edge bearing 6 by means of the switching element 10, the moving contact 5 rests with a defined force against the fixed contact 2. Now if the switching piece 10 is pressed downward in direction S, preferably manually, then the switching element 7 moves along the lower wedge surface 12 out to the wedge peak 13, and the contact force of the moving contact 5 is steadily increased. Finally, when the wedge peak 13 is reached, then due to the pretensioning spring 9 and the cooperation of wedge profile 11 and switching element 7 an oppositely directed force is exerted which strives, on the one hand, to press the switching piece 10 downward and at the same time, to pivot the contact lever 6 upward. Consequently, the moving contact 4 is set onto the fixed contact 3. Without the effect of the restoring spring (not illustrated), the switch would remain in the last-stated position, until finally the switching piece 10 was pulled back opposite to the direction of the arrow S.

Figure 2:
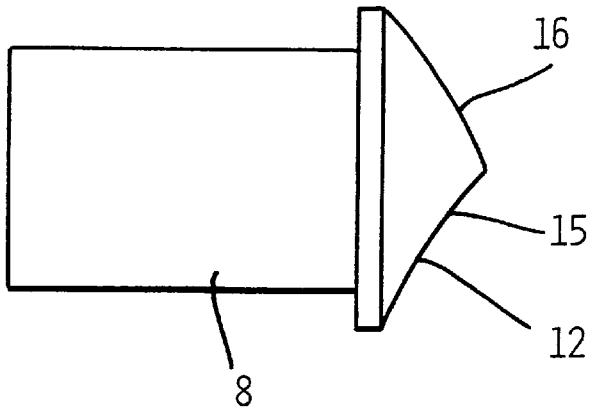
FIG. 2 is a wedge element with wedge profile according to this invention.

Now for the invention, it is important that the wedge profile 11 not have a straight profile, but rather be curved, as is evident from FIG. 2 by the wedge element 8 shown therein. Thus, the entire wedge surface 12 consists of two single wedge surfaces 15, 16 running at a peak toward each other, with the contour of the single wedge surface 15 bulged inward (concave), and the single wedge surface 16 curved outward (convex).

Figure 3:
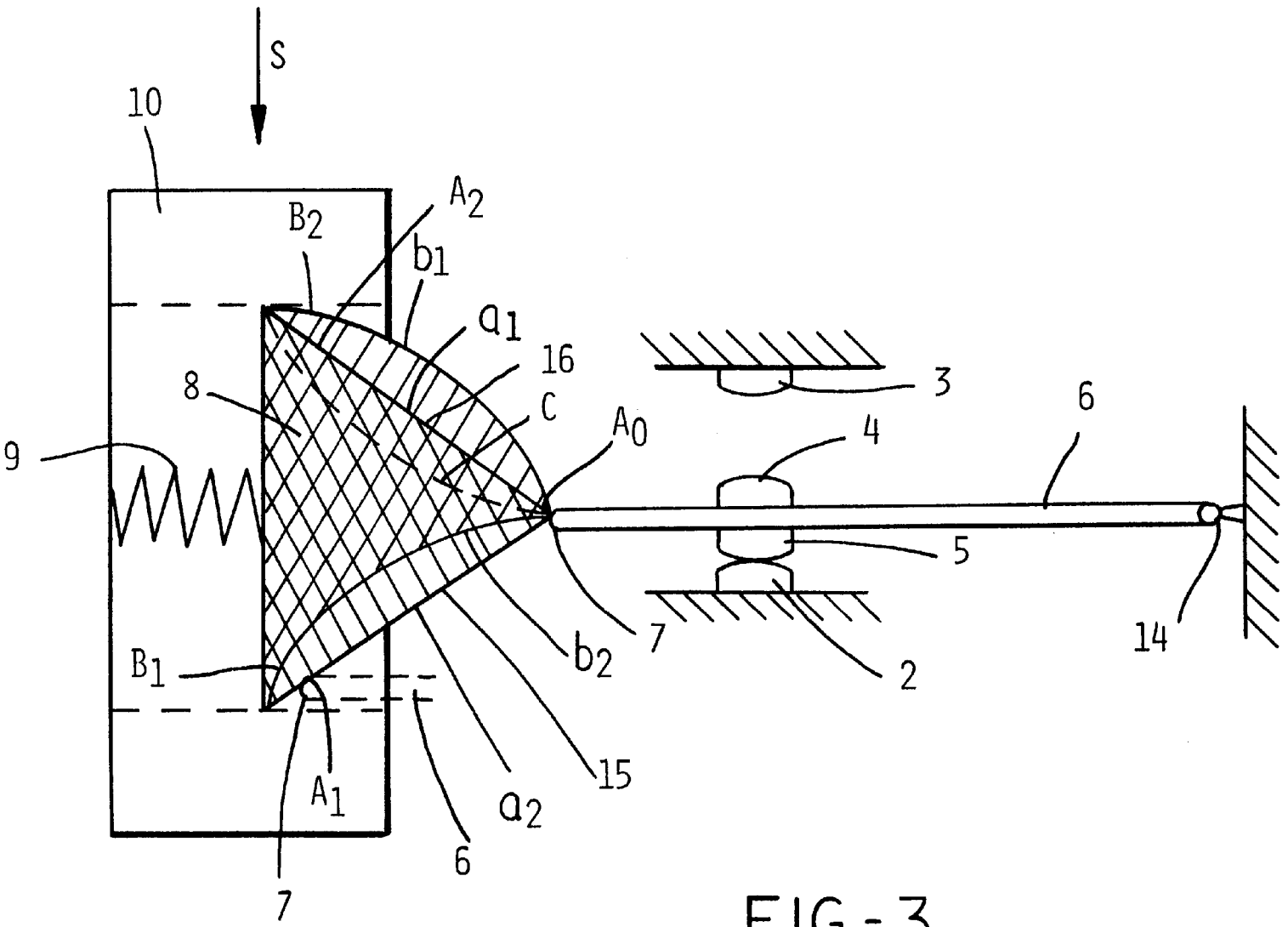
FIG. 3 is a greatly simplified and symbolic representation of the essential elements of the present invention.

FIG. 3 shows the operation of the invention in symbolic form, and the curvature of the wedge surface shown greatly exaggerated. The contours a1 and a2 show the already known profile of the wedge surfaces, in which the force exerted by the pretensioning spring 9 in the direction of the spring S depends linearly on the path traversed by the switching piece 10. Thus, the switching piece 10 moves in the longitudinal direction of the arrow S within the housing, while the contact lever 6 can pivot about the knife-edge bearing 14. In the initial position, the switch piece 10 is located in a position in which (as indicated in FIG. 3) the switching element 7 of the contact lever 6 rests at location A1 against the single wedge surface 15. Thus, the wedge element 8 is extended far under the effect of the spring 9. Now the moving contact 5 is under the proportional force of the mostly pretensioned spring 9 on the fixed contact 2. Now if the switching piece 10 is pressed manually in the direction of the arrow S, for example, then the point A1 moves along the single wedge surface 15 at an upward slant, and the wedge 8 is increasingly pressed to the left due to the effect of the switching piece 10. Due to the increasing force exerted by the pretensioning spring 9, the force pressing the contact 5 onto the contact 2 increases linearly. This continues until finally the point A0 is reached. At this moment, the conditions reverse. Now the spring 9 can relax since the switching piece 10 moves along the second single wedge surface 16 in the direction of the end point A2. The proportionate force exerted by the spring 9 onto the switching element 7 pivots the switching element simultaneously upward around the knife-edge bearing 14, so that now the moving contact 4 rests against the fixed contact 3.

The curved contours b1 and b2 according to this invention are indicated again in FIG. 3. We see that starting from the position B1, the spring tensions only slowly at first, until finally, very large path changes of the wedge element 8 to the left will occur due to small path motions of the switching piece 10, which leads to a considerable change in the force exerted by the operator per path increment. This suddenly increasing force, which ends in sudden release, means that the operator will perceive a definite pressure point so that the operator will know that the reversing process must now be quite close. The second, single wedge surface b1 is indicated greatly exaggerated in FIG. 3 with an outward curvature. Thus, the advantages of the reversing process of the contact lever 6 and thus of the reversing of the switch are attained. It is clear that the spring 9 can initially relax only slowly, so that is relaxation increases quickly in comparison to the path traversed, the closer the point B2 comes to the switching element 7. Due to this feature, the force exerted on the contact 4 can be increased, since initially a comparatively large spring force will be available, whose proportion is relatively small in the motion direction of the contact 4. At point B2 the conditions are reversed, so that the spring force will be comparatively small, while that fraction acting on the contact 4 is quite large.

In FIG. 3, a contour c is indicated which is symmetrical to the contour b2. In this case, the advantages described above with regard to b2 of an inward bulged curvature of the wedge contour for the two single wedge surfaces will take effect for the case in which the switch is operated manually in both directions, and in both directions improved pressure points should be achieved.

The invention can thus be indicated briefly below in the snap-switches known to this time, the bevels of the reverse switching components are of uniform design. Thus, up to the reversal point, a uniform force increase will occur due to the tension of the compression spring. The invention presents a switch in which the bevels of the reversing part are tailored to the particular switch characteristics. That is, when operating the switch key, on the one side of the switch piece, due to the differing designed bevel, a force increase (pressure point) is reached and when releasing the key and thus switching back, due to the radii shape (in spite of pretensioning of the compression spring), a uniform restoring force is achieved. Due to changing this actuation surface, almost all force-path profiles can be attained.

What is claimed is:

1. An electric switch, with a housing, a contact lever moveable between two end settings and pivotal within the housing, a moveable switch piece and at least one fixed contact which is rigidly mounted in the housing and, in one end setting of the contact lever, is tensioned by said housing, whereby one of the contact lever and the switch piece bears a wedge profile and the other of the switch piece and the contact lever has a switch element resting against the wedge profile where the switch piece in the housing can move along a straight path extending essentially perpendicular to a longitudinal direction of the contact lever, and where the switch element and the wedge profile are pretensioned against each other in a direction running essentially perpendicular to the motion direction of the switch piece, characterized in that the contour of at least one of two wedge surfaces forming the wedge profile sensed by the switching element is curved.

2. The electric switch according to claim 1, characterized in that the curvature of the contour sensed from the beginning of the switch operation until a transition point is selected such that the force exerted on the switch piece increases disproportionately with respect to the path traversed by the switch piece.

3. The electric switch according to claim 2, characterized in that the wedge contour sensed after passing the transition point on the wedge profile is convex.

4. The electric switch according to claim 2, characterized in that the contour sensed by the switching element after passing a reversing point on a wedge peak is concave.

5. The electric switch according to claim 1, characterized in that a wedge carrying the wedge profile is pretensioned in the switch piece in the pretension direction.

6. An electric switch comprising:

a housing;

a contact lever movable between two end settings and pivotal within the housing;

a movable switch piece;

at least one fixed contact rigidly mounted in the housing, the at least one fixed contact, in one end setting of the contact lever, tensioned by the housing;

one of the contact lever and the switch piece bearing a wedge profile and the other of the switch piece and the contact lever having a switch element resting against the wedge profile;

the switch piece in the housing movable along a straight path extending essentially perpendicular to a longitudinal direction of the contact lever;

the switch element and the wedge profile being pretensioned against each other in a direction running essentially perpendicular to the motion direction of the switch piece; and a contour of at least one of two wedge surfaces, forming the wedge profile sensed by the switching element, being curved.

7. The electric switch of claim 6 wherein:

the curvature of the contour sensed from the beginning of the switch operation until a transition point is selected such that the force exerted on the switch piece increases disproportionately with respect to the path traversed by the switch piece.

8. The electric switch of claim 7 wherein the contour of the wedge surface sensed after the transition point on the wedge profile is convex.

9. The electric switch of claim 7 wherein:

the contour on the wedge surface sensed by the switching element after passing the transition point on a wedge profile is concave.

10. The electric switch of claim 6, further comprising:

a wedge carrying the wedge profile, the wedge pretensioned in the switch piece in the pretensioned direction.

* * * * *